US008672773B2

(12) United States Patent
Finn

(10) Patent No.: US 8,672,773 B2
(45) Date of Patent: Mar. 18, 2014

(54) IRON-TYPE GOLF CLUB HEAD OR OTHER BALL STRIKING DEVICE

(75) Inventor: Michael E. Finn, Forth Worth, TX (US)

(73) Assignee: Nike, Inc., Beaverton, OR (US)

( * ) Notice: Subject to any disclaimer, the term of this patent is extended or adjusted under 35 U.S.C. 154(b) by 76 days.

(21) Appl. No.: 12/776,158

(22) Filed: May 7, 2010

(65) Prior Publication Data

US 2011/0275452 A1 Nov. 10, 2011

(51) Int. Cl.
*A63B 53/04* (2006.01)

(52) U.S. Cl.
USPC ..... 473/331; 473/350

(58) Field of Classification Search
USPC ..... 473/331, 350
See application file for complete search history.

(56) References Cited

U.S. PATENT DOCUMENTS 1,673,994 A * 6/1928 Quynn ..... 473/330
D298,643 S 11/1988 Mitsui
5,011,151 A 4/1991 Antonious
5,645,495 A 7/1997 Saso
5,695,412 A * 12/1997 Cook ..... 473/349
6,623,374 B1 * 9/2003 Helmstetter et al. ..... 473/291
6,814,673 B2 11/2004 Wahl et al.
2005/0049079 A1 3/2005 Yamamoto
2005/0064953 A1 3/2005 Moore, Jr.
2005/0209018 A1 9/2005 Yamamoto
2005/0277486 A1 12/2005 Hyman
2008/0070718 A1 * 3/2008 Sanchez ..... 473/328
2009/0023513 A1 1/2009 Shibata et al.
2010/0016096 A1 * 1/2010 Burnett et al. ..... 473/327

OTHER PUBLICATIONS

International Search Report & Written Opinion from PCT Application No. PCT/US2011/032832, mailed Aug. 2, 2011.

* cited by examiner

*Primary Examiner* — Michael Dennis
(74) *Attorney, Agent, or Firm* — Banner & Witcoff, Ltd.

(57) ABSTRACT

A ball striking device, such as an iron-type golf club, includes a head that has a face having a ball striking surface defined thereon and an arched top edge, an iron-type golf club body connected to the face, and a hosel connected to the body. The arched top edge of the face includes a crest portion, a first upwardly sloping portion extending from a toe edge of the face to the crest portion, and a second upwardly sloping portion extending from the hosel to the crest portion, such that the distance from the bottom edge of the face to the top edge of the face is greatest at the crest portion. The hosel has a first end connected to the body and a second end located below the crest portion of the face.

39 Claims, 8 Drawing Sheets

PRIOR ART

IRON-TYPE GOLF CLUB HEAD OR OTHER BALL STRIKING DEVICE

TECHNICAL FIELD

The invention relates generally to ball striking devices, such as iron-type golf clubs and heads. Certain aspects of this invention relate to iron-type golf club heads having increased weight distributed proximate the sole of the head.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. When the club face is not square at the point of engagement, the golf ball may fly in an unintended direction and/or may follow a route that curves left or right, ball flights that are often referred to as "pulls," "pushes," "draws," "fades," "hooks," or "slices," or may exhibit more boring or climbing trajectories. Accordingly, club head features that can help a user keep the club face square with the ball would tend to help the ball fly straighter and truer, in the desired direction, and often with improved and/or reliable distance.

The energy or velocity transferred to the ball by a golf club also may be related, at least in part, to the "coefficient of restitution" (or "COR") of the club face at the point of contact. The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the desired ball contact location, usually at the center of the face.

Typically, a golf club head is designed so that the center of gravity of the head is positioned directly behind the desired ball contact location on the face. This configuration maximizes the energy transferred to the ball upon contact and minimizes twisting of the club head when the ball is hit at the desired contact location. Iron-type golf club heads frequently have an enlarged toe to counterbalance the weight of the hosel, maintaining the location of the center of gravity behind the desired ball contact location at the center of the face. Many golfers, particularly inexperienced golfers, can have difficulty in achieving a sufficiently high ball trajectory with iron-type golf clubs. An iron-type club with a lower center of gravity can create a greater amount of lift on a golf ball when struck. Accordingly, an iron-type golf club may benefit from a design that lowers the center of gravity of the head. Additionally, an iron-type golf club head may benefit from a design that positions a greater proportion of the weight behind the desired ball contact location in the center of the face while maintaining the location of the center of gravity behind the desired ball contact location.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include an iron-type head that has a face having a ball striking surface defined thereon and an arched top edge, an iron-type golf club body connected to the face, and a hosel connected to the body. According to some aspects, the arched top edge of the face includes a crest portion, a first upwardly sloping portion extending from a toe edge of the face to the crest portion, and a second upwardly sloping portion extending from the hosel to the crest portion, such that the distance from the bottom edge of the face to the top edge of the face is greatest at the crest portion. Additionally, the hosel has a first end connected to the body and a second end located below the crest portion of the face. According to other aspects, a golf club head as described above may have a lower center of gravity compared to existing club heads.

According to one aspect, the head includes a rear cavity defined on a rear surface of the body located opposite the face. The head may also include a rear wall extending upward from the sole and being spaced from the rear surface of the body. In this configuration, the cavity is defined between the rear wall and the rear surface of the body.

According to another aspect, the hosel is integrally formed as a single piece with the body. Additionally, the face may be integrally formed as a single piece with the hosel and the body.

According to additional aspects, the top edge of the face may have a rounded contour, or a polygonally-arched contour.

According to a further aspect, the ball striking surface may be defined by a vertical, linear heel side and a vertical, linear toe side each extending from the bottom edge to the top edge of the face. In this configuration, the crest portion is located between the heel side and the toe side of the ball striking surface, and the distance from the bottom edge of the face to the top edge of the face is greater at the crest portion than at the heel side or the toe side. In one embodiment, the ball striking surface has a plurality of laterally-extending linear grooves thereon, and none of the grooves extend past the heel side or the toe side.

According to yet another aspect, a length of the first upwardly sloping portion is approximately equal to a length of the second upwardly sloping portion, within +/−25%.

According to a still further aspect, the face has a lateral width measured perpendicularly to the height between the toe edge of the face and a heel edge of the face, and at least ⅓ of the width of the face is located on both sides of the crest portion.

Additional aspects of the invention relate to an iron-type golf club head that includes a face having a ball striking surface and an arched top edge, an iron-type golf club body connected to the face, and a hosel connected to the body. The body includes a sole extending rearward from the bottom edge of the face, a rear cavity defined on a rear surface of the body located opposite the face, and a rear wall extending upward from the sole. The rear wall is spaced from the rear surface of the body and the cavity is defined between the rear wall and the rear surface of the body. The arched top edge of the face includes a crest portion, a first upwardly sloping portion extending from the toe edge of the face to the crest portion, and a second upwardly sloping portion extending from the hosel to the crest portion, such that the distance from the bottom edge of the face to the top edge of the face is greatest at the crest portion.

Further aspects of the invention relate to an iron-type golf club head that includes a face having an arched top edge and a ball striking surface defined by a vertical, linear heel side and a vertical, linear toe side each extending from the bottom edge to the top edge of the face, an iron-type golf club body connected to the face, and a hosel connected to the body. The distance from the bottom edge of the face to the top edge of the face is greater at a crest portion located between the heel side and the toe side of the ball striking surface than at the heel side or the toe side, giving the top edge of the face the arched configuration. The hosel has a first end connected to the body and a second end that is located below the crest portion of the face.

Still further aspects of the invention relate to an iron-type golf club head that includes a face having an arched top edge and a ball striking surface defined by a vertical, linear heel side and a vertical, linear toe side each extending from the bottom edge to the top edge of the face, and an iron-type golf club body connected to the face. The distance from the bottom edge of the face to the top edge of the face is greater at a crest portion located between the heel side and the toe side of the ball striking surface than at the heel side or the toe side, giving the top edge of the face the arched configuration. The body includes a sole extending rearward from the bottom edge of the face, a rear cavity defined on a rear surface of the body located opposite the face, and a rear wall extending upward from the sole. The rear wall is spaced from the rear surface of the body and the cavity is defined between the rear wall and the rear surface of the body.

Other aspects of the invention relate to golf clubs that include a golf club head as described above and a shaft connected to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
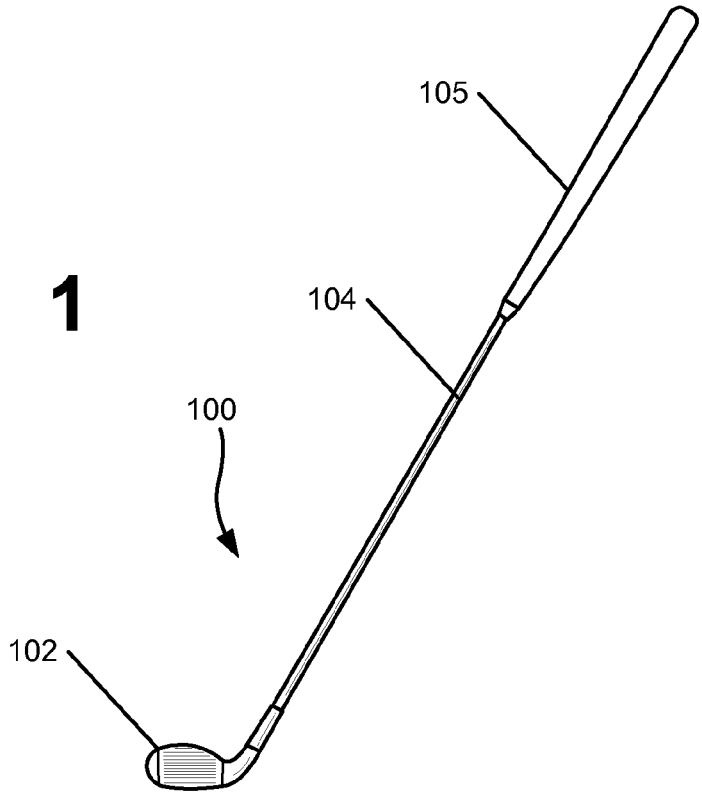
FIG. 1 is a front view of an illustrative embodiment of an iron-type ball striking device according to aspects of the present invention.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to iron-type golf clubs and golf club heads, including long irons, short irons, wedges, etc. Alternately, some aspects of this invention may be practiced with hybrid clubs, chippers, and the like, or wood-type golf clubs and the like.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, as well as long iron clubs (e.g., driving irons, zero irons through five irons), short iron clubs (e.g., six irons through pitching wedges, as well as sand wedges, lob wedges, gap wedges, and/or other wedges), hybrid clubs, and putters. Such devices may include a one-piece construction or a multiple-piece construction. Example structures of ball striking devices according to this invention will be described in detail below in conjunction with FIG. 1, which illustrates an example of a ball striking device 100 in the form of an iron-type golf club, in accordance with at least some examples of this invention.

FIG. 1 illustrates a ball striking device 100 in the form of a golf iron, in accordance with at least some examples of this invention, and illustrative embodiments of heads 102 of ball striking devices 100 of this type are shown in FIGS. 2-15. The golf club head 102 of FIG. 1 may be representative of any iron-type golf club head in accordance with examples of the present invention. As shown in FIG. 1, the ball striking device 100 includes a ball striking head 102 and a shaft 104 connected to the ball striking head 102 and extending therefrom. The ball striking head 102 of the ball striking device 100 of FIG. 1 has a face 112 connected to a body 108, with a hosel 109 extending therefrom. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties.

Figure 2:
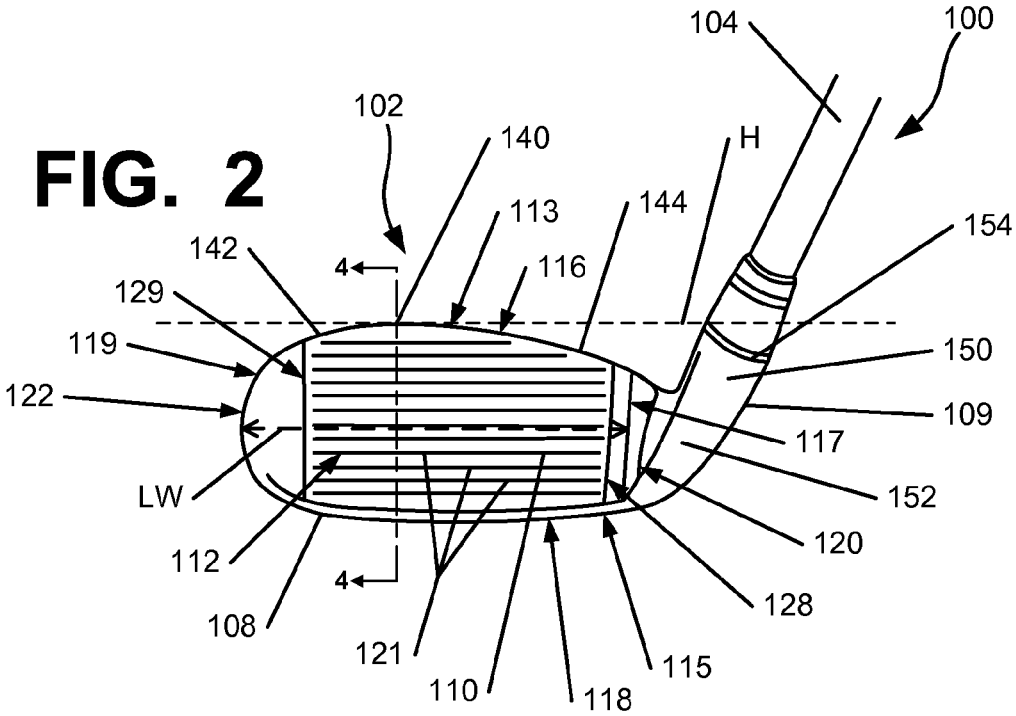
FIG. 2 is a front view of an illustrative embodiment of a head of the ball striking device of FIG. 1.
Figure 3:
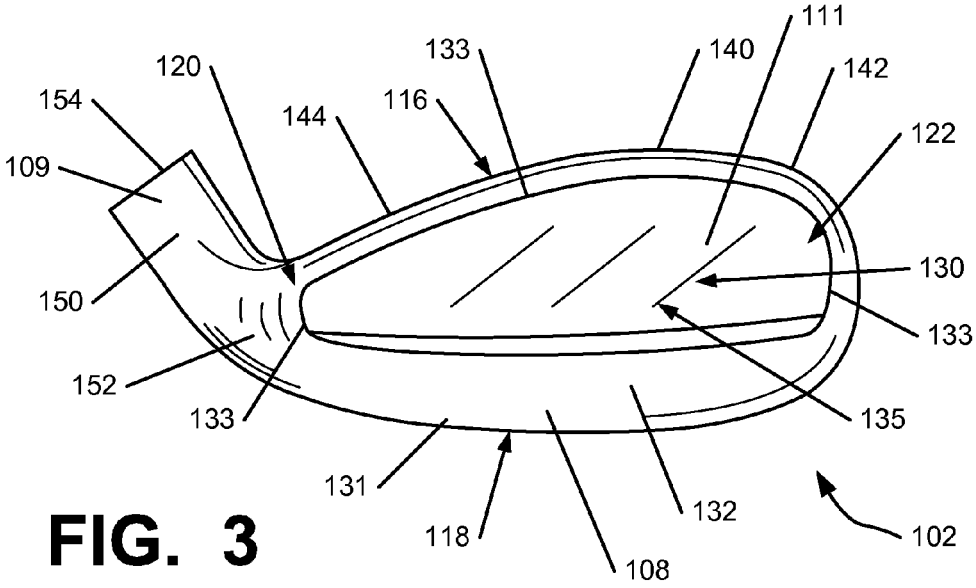
FIG. 3 is a rear view of the head of FIG. 2.
Figure 4:
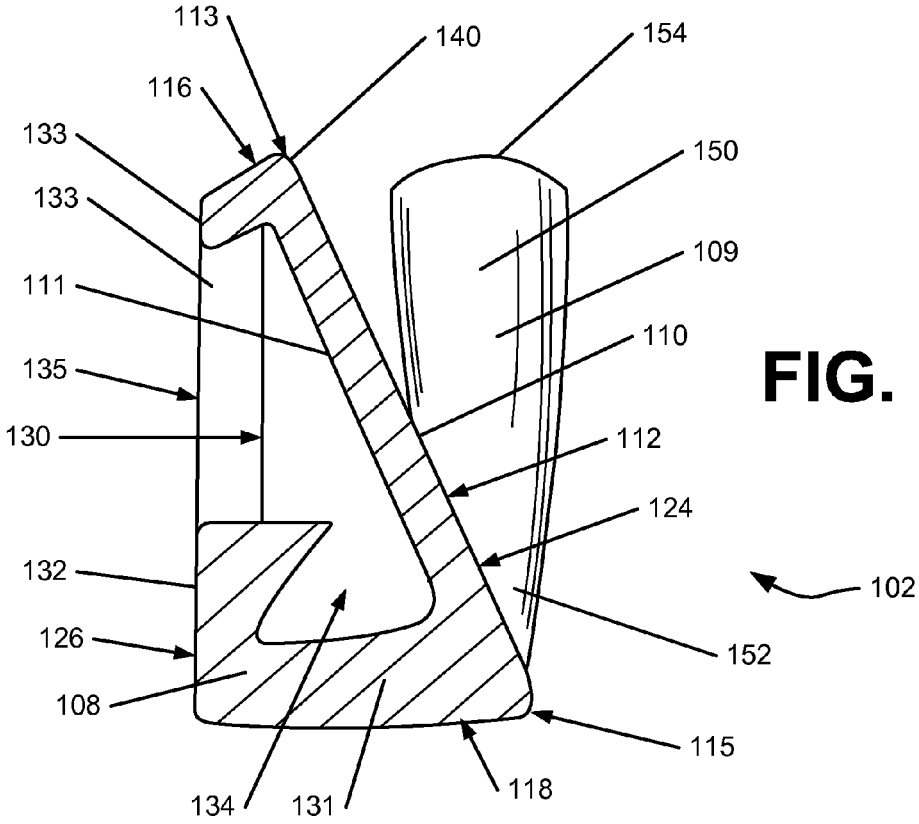
FIG. 4 is a cross-section view taken along lines 4-4 of FIG. 2.

As shown in FIGS. 2-4, the golf club head 102 includes a body member 108 having a face 112 and a hosel 109 extending from the body 108 for attachment of the shaft 104. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. The heel portion 120 is attached to and/or extends from the hosel 109 (e.g., as a unitary or integral one piece construction, as separate connected elements, etc.). In the embodiment shown in FIGS. 1-4, the body 108 and the hosel 109 are formed as a single, integral piece, such as by casting, forging, etc. The face 112 may also be formed of the same single, integral piece with the body 108 and the hosel 109. In another embodiment, the face 112, the body 108, and/or the hosel 109 may be formed of two or more separate pieces that are connected together by an integral joining technique or another joining technique. In other applications, such as for a different type of golf club, the head may be designed to have different dimensions and configurations.

The face 112 is located at the front 124 of the head 102, and has a ball striking surface 110 located thereon. The head 102 has a rear surface 111 located opposite the ball striking surface 110, which may be considered an inner surface of the face 112. The face 112 is defined by a plurality of edges, including a top edge 113, a bottom edge 115, a heel edge 117, and a toe edge 119. Additionally, the face 112 may be recognized as a portion of the head 102 that is intentionally smoothed and/or flattened to be configured for striking the ball, and the edges 113, 115, 117, 119 may be recognized as the borders or boundaries of this intentionally smoothed and/or flattened area.

The ball striking surface 110 is typically an outer surface of the face 112 configured to face a ball (not shown) in use, and is adapted to strike the ball when the device 100 is set in motion, such as by swinging. As shown, the ball striking surface 110 is relatively flat, occupying most of the face 112. The ball striking surface 110 may include grooves 121 (e.g., generally horizontal grooves 121 extending across the face 112 in the illustrated example) for the removal of water and grass from the face 112 during a ball strike. Of course, any number of grooves, desired groove patterns, and/or groove constructions may be provided (or even no groove pattern, if desired), including conventional groove patterns and/or constructions, without departing from this invention.

The ball striking surface 110 may be sized differently in different embodiments, and may be defined in different ways. For example, in one embodiment, the ball striking surface 110 may be generally defined by two vertical linear sides, including a heel side 128 and a toe side 129. These sides may be visible lines on the face 112, which may be created, in some example embodiments, by the ball striking surface 110 having a different finish from other portions of the face 112, or by boundaries of a separate face insert forming the ball striking surface 110. In the embodiments shown in FIGS. 2, 7, 9, and 11, the sides 128, 129 of the ball striking surface 110 are visible lines created by a difference in surface finishes, with the ball striking surface 110 having a relatively more rough and matted finish than other areas of the face 112. The sides 128, 129 may also be conceptual lines defining the boundaries of an area of the face 112 that is specifically designed to contact the ball in use, and may be recognized as the boundaries of an area of the face 112 that is intentionally flattened and textured to be suited for ball contact. In one embodiment, the sides 128, 129 may be conceptually seen as the boundaries of the portion of the face containing the horizontal grooves 121, such that none of the grooves 121 extend past the sides 128, 129 of the ball striking surface 110, which is also the case in the embodiments illustrated in FIGS. 2, 7, 9, and 11. It is understood that in some embodiments, the grooves 121 may extend beyond the boundaries of the ball striking surface 110, such as by extending the entire width of the face 112. In a further embodiment, the conceptual sides 128, 129 of the ball striking surface 110 may extend no more than 1.25 inches laterally on either side of the center of the "hot zone" on the face 112, or 0.200 inches past the edges of the "hot zone." In this embodiment, the width of the ball striking surface 110 may be approximately 2.5 inches. The ball striking surface 110 may be defined in another manner in other embodiments.

For reference purposes, the portion of the face 112 nearest the top face edge 113 and the heel 120 of the head 102 is referred to as the "high-heel area"; the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the ball striking surface 110 may occupy a different proportion of the face 112, or the body 108 may have multiple ball striking surfaces 110 thereon. As seen in the illustrative embodiments in FIGS. 4-6, the ball striking surface 110 is inclined (i.e., at a loft angle), to give the ball an appreciable degree of lift and spin when struck. In other illustrative embodiments, the ball striking surface 110 may have a different incline or loft angle, to affect the trajectory of the ball. Additionally, the face 112 may have a variable thickness and/or may have one or more internal or external inserts in some embodiments. It is understood that the face 112, the body 108, and/or the hosel 109 can be formed as a single piece or as separate pieces that are joined together.

The body member 108 of the golf club head 102 may be constructed from a wide variety of different materials, including materials conventionally known and used in the art, such as steel, titanium, aluminum, tungsten, graphite, polymers, or composites, or combinations thereof, and/or may contain one or more inserts of such materials. Also, if desired, the club head 102 may be made from any number of pieces (e.g., having a separate face plate, etc.) and/or by any construction technique, including, for example, casting, forging, welding, and/or other methods known and used in the art.

The ball striking device 100 may include a shaft 104 connected to or otherwise engaged with the ball striking head 102, as shown schematically in FIG. 1. The shaft 104 is adapted to be gripped by a user to swing the ball striking device 100 to strike the ball. The shaft 104 can be formed as a separate piece connected to the head 102, such as by connecting to the hosel 109, as shown in FIG. 1. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite, a nano-composite, and/or a nano-particle composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 1. The grip element 105 may be attached to the shaft 104 in any desired manner, including in conventional manners known and used in the art (e.g., via adhesives or cements, threads or other mechanical connectors, swedging/swaging, etc.).

In one exemplary embodiment, shown in FIGS. 1-4, the body 108 of the head 102 includes a rear cavity 130 located behind the face 112, which is defined at least partially by the rear surface 111. As shown in FIGS. 3-4, the body 108 further includes a sole body portion 131 extending rearward from the bottom edge 115 of the face 112, and the rear cavity 130 is also partially defined by a rear wall 132 extending upward from the rear of the sole portion 131. The rear cavity 130 may also be partially defined by perimeter walls 133 extending rearward from the top edge 113 of the face 112 and the heel 120 and toe 122 of the head 102. The perimeter walls 133 follow the curvilinear contour of the body 108, and form a semi-circular opening 135 to the rear cavity 130 defined by the perimeter walls 133 and the top edge of the rear wall 132. In this embodiment, the sole portion 131 forms at least part of the sole 118 of the head 102, and the mass of the sole portion 131 lowers the center of gravity of the head 102, which in turn, can produce greater loft on balls hit on the face 112. Additionally, in this embodiment, a portion of the rear cavity 130 is formed as a rear channel 134 extending along the sole portion 131, defined between the rear wall 132 and the rear surface 111. As described above, in this embodiment, the entire body 108 and face 112 are formed of a single, integral piece, however in one embodiment, part or all of the sole portion 131 may be formed of a separate piece from the face 112 and the rest of the body 108. In another embodiment, the rear wall 132 may extend a greater or smaller height from the sole portion 131, and may completely enclose the rear cavity 130 in one embodiment.

In the embodiment shown in FIGS. 1-4, the head 102 has a top 116 that is arched, such that the area 140 of maximum height is located closer to the center of the face 112 and/or the center of gravity of the head 102 relative to existing iron-type golf clubs. This area 140 of maximum height may be referred to as a "crest" or "crest portion" herein. In this embodiment, the top 116 of the head 102 and the top edge 113 of the face 112 are both arched, such that the crest portion 140 represents the maximum height of the head 102 if the height is measured from the sole 118 to the top 116 of the head 102 or from the bottom edge 115 to the top edge 113 of the face 112. The arched configuration of the top 116 of the head 102 and the top edge 113 of the face 112 is formed by two sloping portions 142, 144. A first upwardly sloping portion 142 slopes upward from the toe edge 119 of the face 112 to the crest portion 140, and a second upwardly sloping portion 144 slopes upward from the heel edge 117 of the face 112 and the hosel 109 to the crest portion 140. The sloping portions 142, 144 and the crest portion 140 form a smooth curvilinear contour on the top edge 113 of the face 112. Additionally, the top 116 of the head 102 is sloped and contoured similarly to the top edge 113 of the face 112.

In one exemplary embodiment, the first and second sloping portions 142, 144 have similar lengths, such that at least ⅓ (33%) of the maximum lateral width of the face 112 is located on both sides of the crest portion 140. As referenced herein, the maximum lateral width of the face 112 is measured perpendicularly to the height between the toe edge 119 and the heel edge 117 of the face 112, and is designated by the reference character "LW" in FIG. 2. In the embodiment shown in FIGS. 1-4, at least 40% of the maximum lateral width LW of the face 112 is located on both sides of the crest portion 140. As shown in FIG. 2, the first sloping portion 142 has a smaller length than the second sloping portion 144, placing the crest portion 140 closer to the toe 122 than the heel 120. In a further embodiment, the crest portion 140 is aligned with an approximate midpoint between the heel and toe sides 128, 129 of the ball striking surface 110 and/or an approximate midpoint between the heel and toe edges 117, 119 of the face 112, such that approximately 50% of the lateral width of the face 112 is located on each side of the crest portion 140, such as the embodiments shown in FIGS. 9 and 11 and described below.

In another exemplary embodiment, the first and second sloping portions 142, 144 have similar lengths, such that length of the first upwardly sloping portion 142 is approximately equal to a length of the second upwardly sloping portion 144, within +/−25%. In other words, the length of the first portion 142 is between 75% and 125% of the length of the second portion 144. In one embodiment, such as the embodiment of the head 402 illustrated in FIGS. 7-8 and described in greater detail below, the length of the first upwardly sloping portion 442 is greater than the length of the second upwardly sloping portion 444, such that the crest 440 is located more proximate the heel 420 than to the toe 422, and the ratio of the length of the first portion 442 to the second portion 444 is between 1.2:1 and 1.3:1.

In a further exemplary embodiment, the top edge 113 of the face 112 at the crest portion 140 has a radius of curvature of about 2.5-3.0". In this embodiment, this radius of curvature at the crest portion 140 also represents the minimum radius of curvature of the top face edge 113 at any point between the edges 128, 129 of the ball striking surface 110. This radius of curvature is larger than the radius of curvature at the crests of some existing golf club heads, such as the crest 40 of the head 2 shown in FIGS. 16-17.

In the embodiment shown in FIGS. 1-4, the head 102 has a hosel 109 that is shorter in length and height relative to the hosels of existing iron-type golf clubs. As shown in FIGS. 2-3, the hosel 109 has an elongated hosel body 150 with a first end 152 connected to the body 108 at the heel 120 of the head 102 and a second end 154 opposite the first end 152. As described above, the hosel 109 is integrally formed as a single piece with the body 108 of the head 102, and thus, the first end 152 is integrally connected to the body 108. In another embodiment, the hosel 109 may be a separate piece, and the first end 152 may be connected to the body 108 in another manner. The second end 154 is located away from the body 108, such that the hosel body 150 extends upwardly and outwardly away from the body 108. The second end 154 is a free end configured for connection to the shaft 104, and may contain an opening to receive a portion of the shaft 104 and/or other connection structure as described above. In this embodiment, the hosel 109 has a height measured from the sole 118 and/or the bottom edge 115 of the face 112 that is shorter than the height of the crest portion 140. In other words, the entire hosel 109 is located below the crest portion 140 when in a traditional lie position (the sole 118 resting on the playing surface), including the entire second end 154 of the hosel 109, in this embodiment. The height of the crest portion 140 is indicated by broken line H in FIG. 2, and the entire hosel 109 is located below the height line H in this embodiment. As stated elsewhere herein, the length of the hosel 109 may be different in other embodiments.

The shorter hosel 109 imparts less weight to the heel 120 of the club head 102 compared to many existing club heads 102. This decreased weight near the heel 120 can offset the decreased weight in the toe 122 caused by the arched configuration of the top 116 of the head 102, so that the center of gravity is not moved appreciably. As a result of the shorter length/height of the hosel 109 and the contour of the top 113 of the head 102 in the embodiment of FIGS. 1-4, as well as the enlarged sole portion 131 and the rear wall 132 of the body 108, the head 102 has less material distributed near the top 113 of the head 102, and the center of gravity of the head 102 is lowered, compared to existing iron-type club heads, which can aid in creating more lift on a ball when struck, as described below. FIGS. 7-15 illustrate additional embodiments of iron-type golf clubs 400, 500, 600, 700, 800, 900 and heads 402, 502, 602, 702, 802, 902 that may incorporate features similar to those described above with respect to the club 100 shown in FIGS. 1-4.

Figure 7:
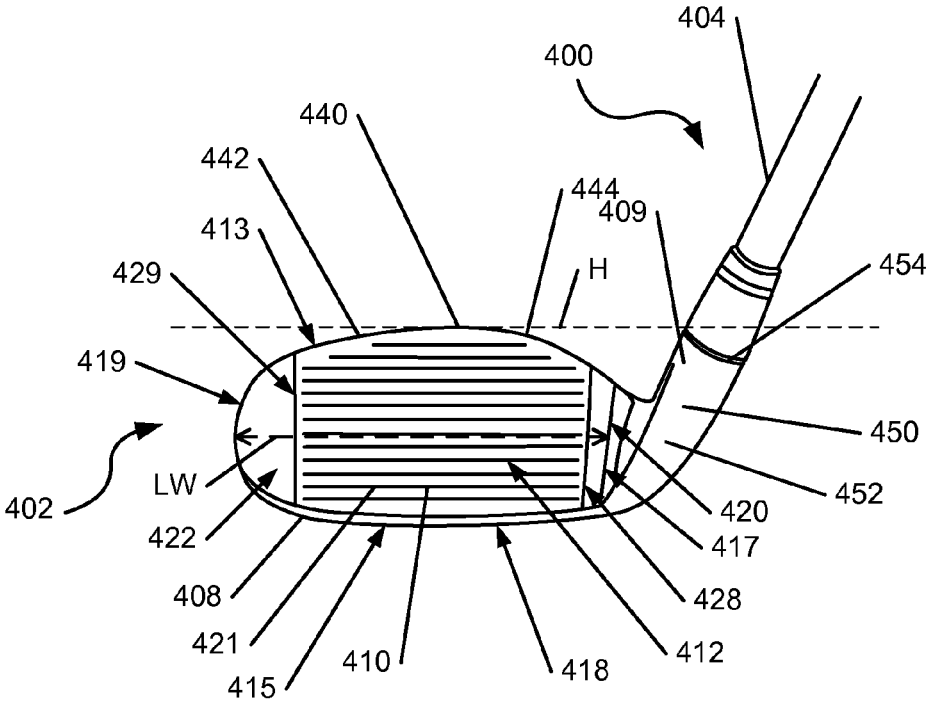
FIG. 7 is a front view of a fourth illustrative embodiment of a head of a ball striking device according to aspects of the present invention.
Figure 8:
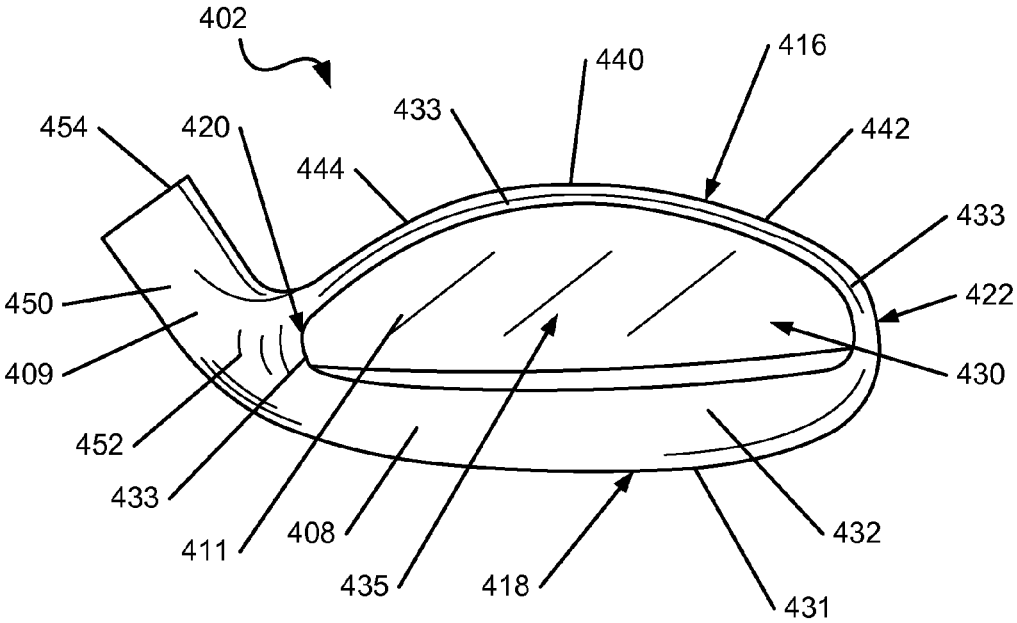
FIG. 8 is a rear view of the head of FIG. 7.

FIGS. 7-8 illustrate another embodiment of a head 402 for a ball striking device 400 that includes a shortened hosel 409 and an arched top 413, similarly to the head 102 described above and shown in FIGS. 1-4. Many features of the club 400 and the head 402 shown in FIGS. 7-8 are similar to features described above with respect to the club 100 and the head 102 in FIGS. 1-4. Such similar features are referenced in FIGS. 7 and 8 with similar reference numerals, using the "4xx" series of reference numerals. In this embodiment, the top 416 of the head 402 and the top edge 413 of the face 412 are both arched, such that the crest portion 440 represents the maximum height of the head 402, as similarly described above with respect to FIGS. 1-4. As such, that the crest portion 440 is located closer to the center of the face 412 and/or the center of gravity of the head 402 relative to existing iron-type golf clubs. The arched configuration of the top 416 of the head 402 and the top edge 413 of the face 412 is formed by two sloping portions 442, 444, forming a rounded configuration. A first upwardly sloping portion 442 slopes upward from the toe edge 419 of the face 412 to the crest portion 440, and a second upwardly sloping portion 444 slopes upward from the heel edge 417 of the face 412 and the hosel 409 to the crest portion 440. The sloping portions 442, 444 and the crest portion 440 form a smooth curvilinear contour on the top edge 413 of the face 412. Additionally, the top 416 of the head 402 is sloped and contoured similarly to the top edge 413 of the face 412.

In the embodiment shown in FIGS. 7-8, the first sloping portion 442 has a slightly greater length than the second sloping portion 444, such that the crest portion 440 is proximate the midpoint between the heel and toe sides 428, 429 of the ball striking surface 410 and/or a midpoint between the heel and toe edges 417, 419 of the face 412. In this embodiment, the ratio of the length of the first portion 442 to the second portion 444 is between approximately 1.2:1 and 1.3:1, and slightly more than 50% of the lateral width (LW) of the face 412 is located on the toe 422 side of the crest portion 440. Accordingly, the crest portion 440 is located more proximate to the toe 422 than the crest portion 140 in the embodiment of FIGS. 1-4.

The hosel 409 of the head 402 in the embodiment shown in FIGS. 7-8 is similar in length and configuration to the hosel 109 of the head 102 described above and shown in FIGS. 1-4. As described above, the hosel 409 has an elongated hosel body 450 with a first end 452 connected to the body 408 at the heel 420 of the head 402 and a second end 454 opposite the first end 452. Similar to the hosel 109 described above, the hosel 409 is integrally formed as a single piece with the body 408 of the head 402, and thus, the first end 452 is integrally connected to the body 408. In this embodiment, the hosel 409 has a height measured from the sole 418 and/or the bottom edge 415 of the face 412 that is shorter than the height of the crest portion 440 (indicated by line H in FIG. 7), and is similar in height to the hosel 109 of the head 102 in FIGS. 1-4. In other words, the entire hosel 409 is located below the crest portion 440, including the entire second end 454 of the hosel 409 in this embodiment.

Figure 9:
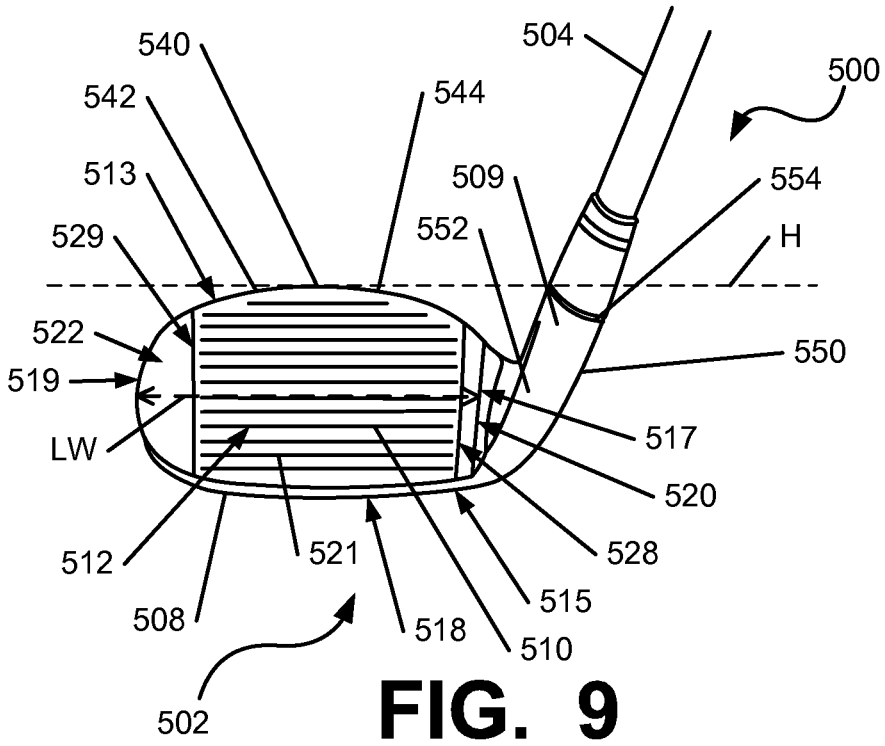
FIG. 9 is a front view of a fifth illustrative embodiment of a head of a ball striking device according to aspects of the present invention.
Figure 10:
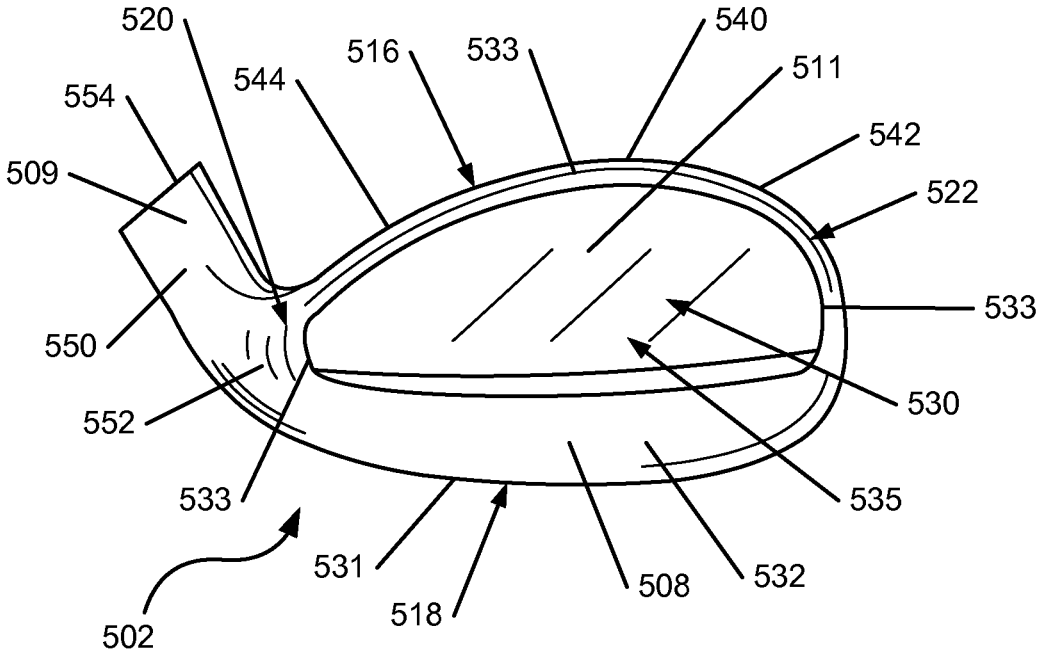
FIG. 10 is a rear view of the head of FIG. 9.

FIGS. 9-10 illustrate another embodiment of a head 502 for a ball striking device 500 that includes a shortened hosel 509 and an arched top 513, similarly to the heads 102, 402 described above and shown in FIGS. 1-4 and 7-8. Many features of the club 500 and the head 502 shown in FIGS. 9-10 are similar to features described above with respect to the club 100 and the head 102 in FIGS. 1-4. Such similar features are referenced in FIGS. 9 and 10 with similar reference numerals, using the "5xx" series of reference numerals. In this embodiment, the top 516 of the head 502 and the top edge 513 of the face 512 are both arched, such that the crest portion 540 represents the maximum height of the head 502, as similarly described above with respect to FIGS. 1-4. As such, that the crest portion 540 is located closer to the center of the face 512 and/or the center of gravity of the head 502 relative to existing iron-type golf clubs. The arched configuration of the top 516 of the head 502 and the top edge 513 of the face 512 is formed by two sloping portions 542, 544, forming a rounded configuration. A first upwardly sloping portion 542 slopes upward from the toe edge 519 of the face 512 to the crest portion 540, and a second upwardly sloping portion 544 slopes upward from the heel edge 517 of the face 512 and the hosel 509 to the crest portion 540. The sloping portions 542, 544 and the crest portion 540 form a smooth curvilinear contour on the top edge 513 of the face 512. Additionally, the top 516 of the head 502 is sloped and contoured similarly to the top edge 513 of the face 512.

In the embodiment shown in FIGS. 9-10, the first sloping portion 542 has approximately the same length as the second sloping portion 544. As such, the crest portion 540 is aligned with an approximate midpoint between the heel and toe sides 528, 529 of the ball striking surface 510 and/or an approximate midpoint between the heel and toe edges 517, 519 of the face 512, such that approximately 50% of the lateral width (LW) of the face 512 is located on each side of the crest portion 540. Accordingly, the crest portion 540 is located more proximate to the center of the face 512 and the center of gravity of the head 502 than the crest portion 140 in the embodiment of FIGS. 1-4. The head 502 and the face 512 in this embodiment have a shorter lateral width than the heads 102, 402 and faces 112, 412 described above and shown in FIGS. 1-4 and 7-8.

The hosel 509 of the head 502 in the embodiment shown in FIGS. 9-10 is similar in length and configuration to the hosel 109 of the head 102 described above and shown in FIGS. 1-4. As described above, the hosel 509 has an elongated hosel body 550 with a first end 552 connected to the body 508 at the heel 520 of the head 502 and a second end 554 opposite the first end 552. Similar to the hosel 109 described above, the hosel 509 is integrally formed as a single piece with the body 508 of the head 502, and thus, the first end 552 is integrally connected to the body 508. In this embodiment, the hosel 509 has a height measured from the sole 518 and/or the bottom edge 515 of the face 512 that is shorter than the height of the crest portion 540 (indicated by line H in FIG. 9), and is similar in height to the hosel 109 of the head 102 in FIGS. 1-4. In other words, the entire hosel 509 is located below the crest portion 540, including the entire second end 554 of the hosel 509 in this embodiment.

Figure 11:
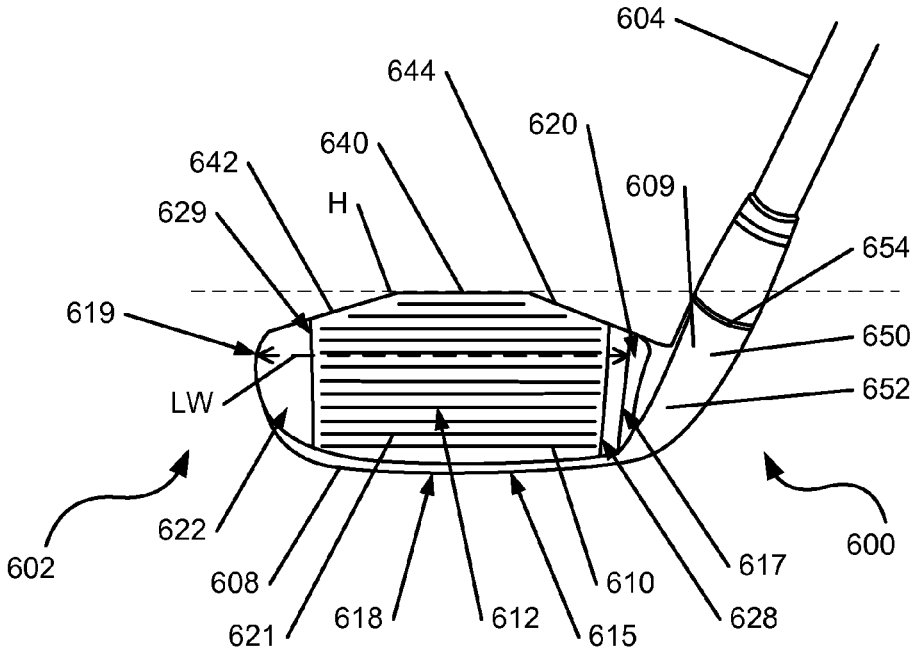
FIG. 11 is a front view of a sixth illustrative embodiment of a head of a ball striking device according to aspects of the present invention.
Figure 12:
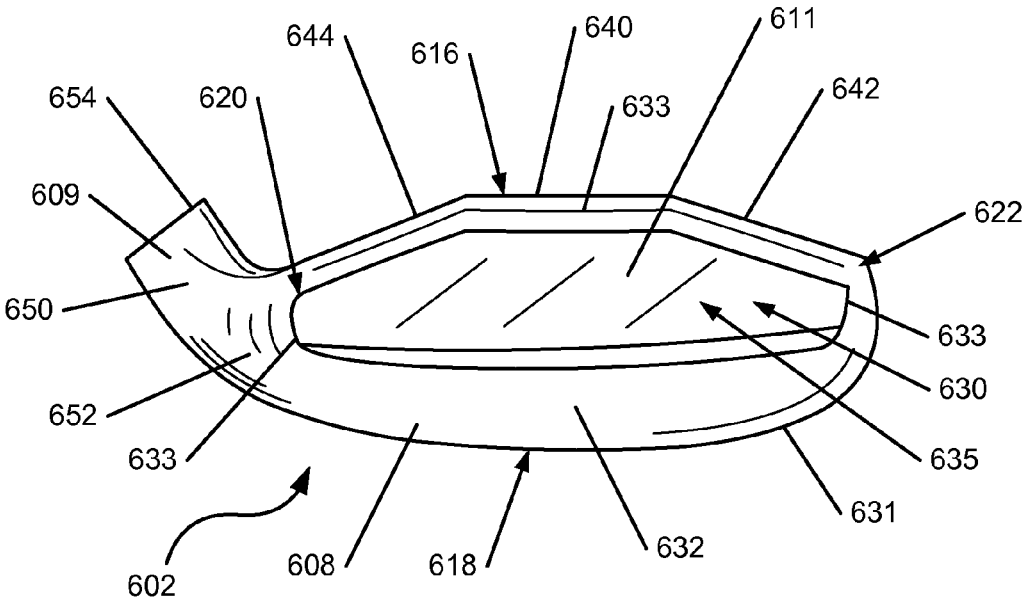
FIG. 12 is a rear view of the head of FIG. 11.

FIGS. 11-12 illustrate another embodiment of a head 602 for a ball striking device 600 that includes a shortened hosel 609 and an arched top 613. Many features of the club 600 and the head 602 shown in FIGS. 11-12 are similar to features described above with respect to the club 100 and the head 102 in FIGS. 1-4. Such similar features are referenced in FIGS. 11-12 with similar reference numerals, using the "6xx" series of reference numerals. In this embodiment, the top 616 of the head 602 and the top edge 613 of the face 612 are both arched, such that the crest portion 640 represents the maximum height of the head 602, as similarly described above with respect to FIGS. 1-4. As such, that the crest portion 640 is located closer to the center of the face 612 and/or the center of gravity of the head 602 relative to existing iron-type golf clubs. The arched configuration of the top 616 of the head 602 and the top edge 613 of the face 612 is formed by two generally linear sloping portions 642, 644 and a generally linear crest portion 640. This configuration forms a polygonally-shaped arched configuration at the top 613 of the head 602, in contrast to the rounded configurations in FIGS. 1-4 and 7-10. A first generally linear upwardly sloping portion 642 slopes upward from the toe edge 619 of the face 612 to the crest portion 640, and a second generally linear upwardly sloping portion 644 slopes upward from the heel edge 617 of the face 612 and the hosel 609 to the crest portion 640. The sloping portions 642, 644 and the crest portion 640 form a continuous polygonal contour on the top edge 613 of the face 612. Additionally, the top 616 of the head 602 is sloped and contoured similarly to the top edge 613 of the face 612.

In the embodiment shown in FIGS. 11-12, the first sloping portion 642 has a similar length to the second sloping portion 644, and the crest portion 640 is generally centered on the head 602, such that the center of the crest portion 640 is approximately in line with the center of the face 612 and the center of gravity of the head 602. As such, the crest portion 640 is aligned with an approximate midpoint between the heel and toe sides 628, 629 of the ball striking surface 610 and/or an approximate midpoint between the heel and toe edges 617, 619 of the face 612, such that approximately 50% of the lateral width (LW) of the face 612 is located on each side of the center of the crest portion 640.

The hosel 609 of the head 602 in the embodiment shown in FIGS. 11-12 is similar in length and configuration to the hosel 109 of the head 102 described above and shown in FIGS. 1-4. As described above, the hosel 609 has an elongated hosel body 650 with a first end 652 connected to the body 608 at the heel 620 of the head 602 and a second end 654 opposite the first end 652. Similar to the hosel 109 described above, the hosel 609 is integrally formed as a single piece with the body 608 of the head 602, and thus, the first end 652 is integrally connected to the body 608. In this embodiment, the hosel 609 has a height measured from the sole 618 and/or the bottom edge 615 of the face 612 that is shorter than the height of the crest portion 640 (indicated by line H in FIG. 11), and is similar in height to the hosel 109 of the head 102 in FIGS. 1-4. In other words, the entire hosel 609 is located below the crest portion 640, including the entire second end 654 of the hosel 609 in this embodiment.

Figure 13:
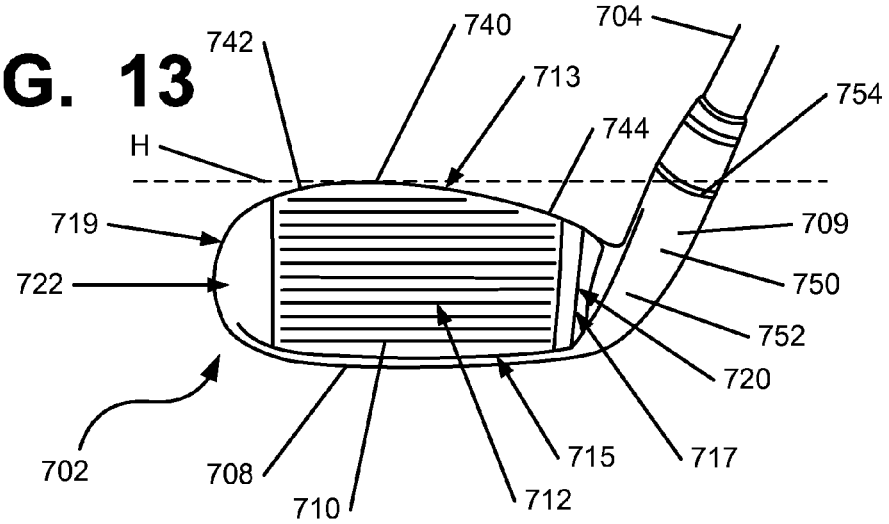
FIG. 13 is a front view of a seventh illustrative embodiment of a head of a ball striking device according to aspects of the present invention.
Figure 14:
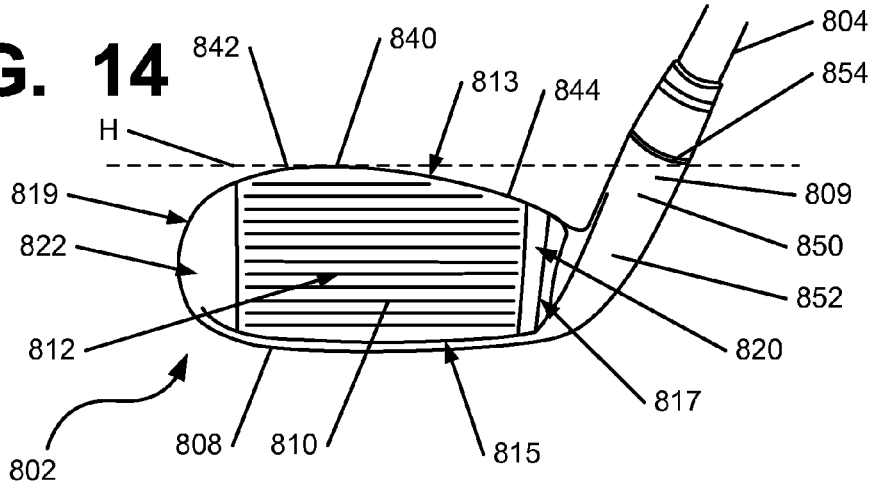
FIG. 14 is a front view of an eighth illustrative embodiment of a head of a ball striking device according to aspects of the present invention.
Figure 15:
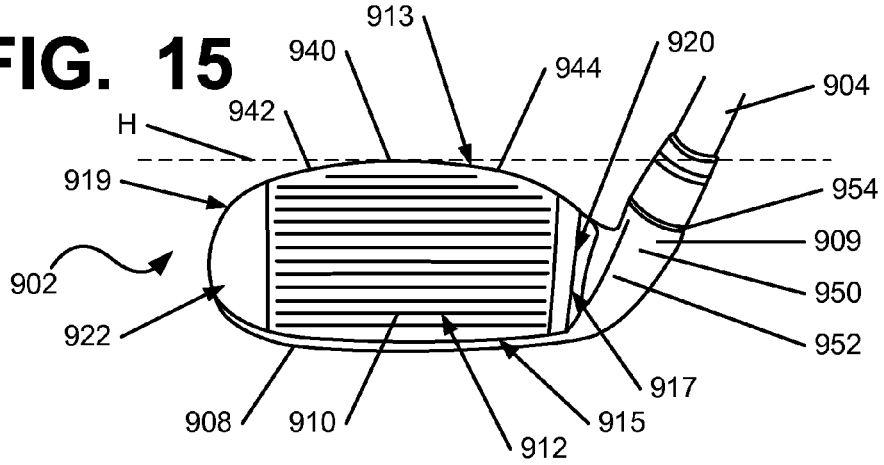
FIG. 15 is a front view of a ninth illustrative embodiment of a head of a ball striking device according to aspects of the present invention.

FIGS. 13-15 illustrate additional embodiments of heads 702, 802, 902 that contain hosels 709, 809, 909 of varying lengths. These embodiments are described individually in greater detail below. As described below, the length of the hosel 109, et seq. and the configuration of the top 113, et seq. of the head 102, et seq. can be designed to affect the weight distribution of the head 102, et seq. and the position of the center of gravity of the head 102 et seq.

FIG. 13 illustrates an exemplary embodiment of a head 702 of a ball striking device 700 that has a body 708 and a face 712 configured similarly or identically to the body 108 and face 112 of the head 102 in FIGS. 1-4. Features of the club 700 and the head 702 shown in FIG. 13 that are similar to features described above with respect to the club 100 and the head 102 in FIGS. 1-4 are referenced in FIG. 13 with similar reference numerals, using the "7xx" series of reference numerals. In this embodiment, the hosel 709 has a slightly longer length than the hosel 109 in FIG. 2, and a portion of the second end 754 of the hosel 709 extends above the height of the crest portion 740, as indicated by the broken line H in FIG. 13. Accordingly, in this embodiment, the center of gravity of the head 702 of FIG. 13 may be located slightly closer to the heel 720 and slightly closer to the top 713 of the head 702 as compared to the center of gravity of the head 102 of FIGS. 1-4.

FIG. 14 illustrates an exemplary embodiment of a head 802 of a ball striking device 800 that has a body 808 and a face 812 configured similarly or identically to the body 108 and face 112 of the head 102 in FIGS. 1-4. Features of the club 800 and the head 802 shown in FIG. 14 that are similar to features described above with respect to the club 100 and the head 102 in FIGS. 1-4 are referenced in FIG. 14 with similar reference numerals, using the "8xx" series of reference numerals. In this embodiment, the hosel 809 has a slightly longer length than the hosel 109 in FIG. 2, and the entire second end 854 of the hosel 809 extends above the height of the crest portion 840, as indicated by the broken line H in FIG. 14. Accordingly, in this embodiment, the center of gravity of the head 802 of FIG. 14 may be located slightly closer to the heel 820 and slightly closer to the top 713 of the head 702 as compared to the centers of gravity of the head 102 of FIGS. 1-4 and the head 702 of FIG. 13.

FIG. 15 illustrates an exemplary embodiment of a head 902 of a ball striking device 900 that has a body 908 and a face 912 configured similarly to the body 108 and face 112 of the head 102 in FIGS. 1-4, except that the crest 940 is located more proximate the center of the head 902 than the crest portion 140 in FIGS. 1-4. Features of the club 900 and the head 902 shown in FIG. 15 that are similar to features described above with respect to the club 100 and the head 102 in FIGS. 1-4 are referenced in FIG. 15 with similar reference numerals, using the "9xx" series of reference numerals. In this embodiment, the hosel 909 has a slightly shorter length than the hosel 109 in FIG. 2 and the hosel 409 in FIG. 7, and the entire second end 954 of the hosel 909 is located significantly below the height of the crest portion 940, as indicated by the broken line H in FIG. 15. Accordingly, in this embodiment, the center of gravity of the head 902 of FIG. 15 may be located slightly closer to the toe 922 and the sole 918 of the head 902 as compared to the center of gravity of the head 402 of FIGS. 7-8. However, the crest portion 940 is located closer to the center of the head 902 as compared to the head 102 in FIGS. 1-4. Thus, the decrease in weight and heel-shifting of the center of gravity caused by the shorter hosel 909 will also be partially offset by a decrease in weight due to a smaller amount of material in the toe 922 of the head 902.

As stated above, FIGS. 13-15 illustrate how the center of gravity of the head 102, et seq. can be moved by changing the shape of the head 102, et seq. and/or the height and length of the hosel 109, et seq. Further variations in the shape and contour of the top 113, et seq. of the head 102, et seq. and the length and/or height of the hosel 109, et seq. may be used to create a head 102, et seq. having a center of gravity in a desired location and a greater proportion of the weight of the head 102, et seq. located at or near the center of gravity.

Additionally, variations in the structure of the body 108, et seq., including the size and configuration of the sole portion 131, et seq., can move the center of gravity of the head, as described below.

Figure 5:
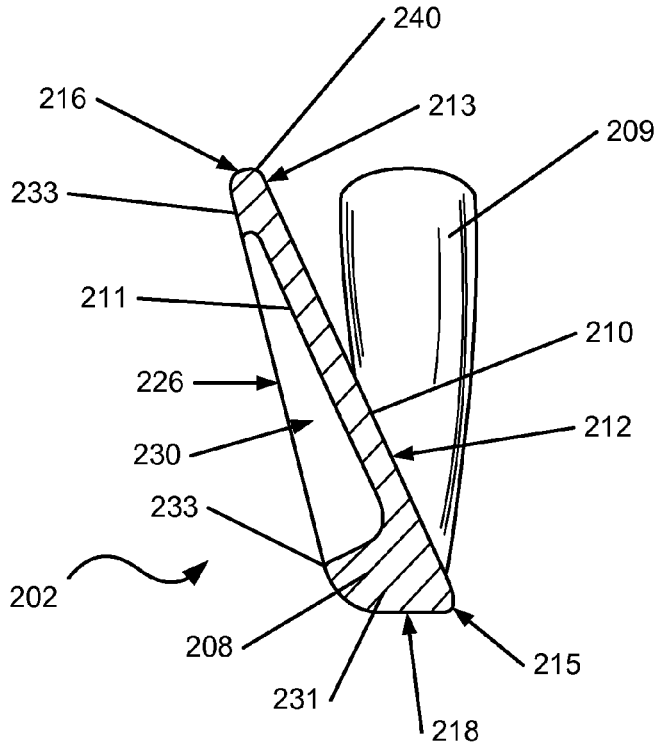
FIG. 5 is a cross-section view of a second illustrative embodiment of a head of a ball striking device according to aspects of the present invention.
Figure 6:
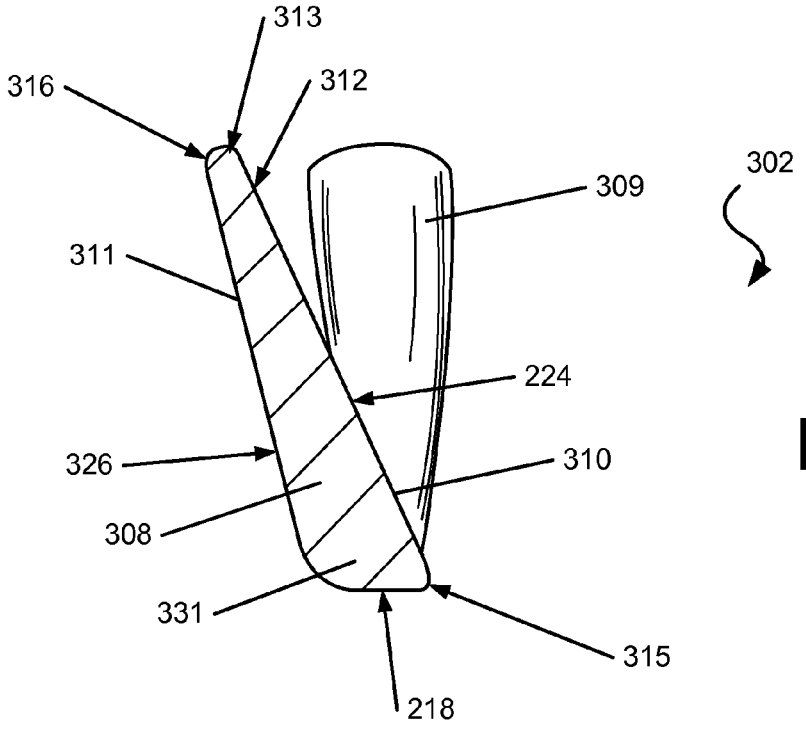
FIG. 6 is a cross-section view of a third illustrative embodiment of a head of a ball striking device according to aspects of the present invention.

In other embodiments, at least some of the features described herein can be used in connection with a full, partial, or split cavity-back iron or similar club head, such as the iron-type club head 202 shown in FIG. 5, or a blade-type iron or similar club head, such as the iron-type club head 302 shown in FIG. 6. The club head 202 shown in FIG. 5 represents one example of a cavity-back iron, and includes a rear cavity 230 that is defined by the rear surface 211 of the body 208 and perimeter walls 233 extending rearward from the top edge 213 of the face 212 and the heel and toe (not shown) of the head 202. In this embodiment, the body 208 also has a sole portion 231 that forms at least part of the sole 218 of the head 202 and defines a portion of the rear cavity 230. The sole portion 231 of this embodiment is smaller than the sole portion 131 of the head 102 shown in FIGS. 1-4, and thus, the center of gravity of the head 202 in this embodiment may be slightly higher as compared to the center of gravity of the head 102 of FIGS. 1-4. It is understood that in another embodiment, the head 202 may contain a sole portion 231 that is enlarged, similarly to the sole portion 131 in the head 102 of FIG. 4. Changing the size of the sole portion 131, 231 may move the center of gravity of the head 102, 202 higher or lower. In this embodiment, the body 208, the face 212, and the hosel 209 are formed of a single, integral piece, but in other embodiments, one or more of these components may be formed separately.

The club head 302 shown in FIG. 6 represents one example of a blade-type iron, and includes a solid body 308 with no rear cavity. In this embodiment, the body 308, the face 312, and the hosel 309 are formed of a single, integral piece, but in other embodiments, one or more of these components may be formed separately. Due at least in part to the lack of a back cavity, the center of gravity of the head 302 in this embodiment may be slightly higher as compared to the centers of gravity of the heads 102, 202 in FIGS. 1-5. Other features of the club heads 202, 302 shown in FIGS. 5-6 are similar to features described above with respect to the club 100 in FIGS. 1-4. Such similar features are referenced in FIGS. 5 and 6 with similar reference numerals using the "2xx" and "3xx" series of reference numerals, respectively. It is understood that the cross-sectional configurations of the heads 202, 302 shown in FIGS. 5 and 6 may be used with various head configurations, and that the heads 202, 302 may appear similar or identical to one of the heads 102, 402, 502, 602, 702 shown in FIG. 1-2, 7, 9, or 11, when viewed from the front, depending on the configuration of the heads 202, 302. It is also understood that the cross-sectional configuration of the heads 202, 302 in FIGS. 5 and 6 can be used in other head configurations as well. In further embodiments, at least some of the features described herein can be used in connection with other configurations of iron-type clubs, or with other non-iron-type clubs.

Several different embodiments have been described above, including the embodiments shown in FIGS. 1-15. It is understood that any of the features of these various embodiments may be combined and/or interchanged. For example, as described above, various different combinations of club heads 102, et seq. with differently shaped bodies 108, et seq. and hosels 109, et seq. having different lengths and/or heights, as well as different sole portions 131 et seq. and rear cavities 130, et seq. (or lack thereof) may be used to position the center of gravity of the head 102, et seq. in a desired location and/or to control the proportion of the weight of the head 102, et seq. positioned at or near the center of gravity of the head 102, et seq.

Heads 102 incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. Additionally, the head 102, golf club 100, or other ball striking device may be fitted or customized for a person by custom fitting, which may include selection of a head 102 having a particular weight distribution that is suited for a particular golfer. For example, a higher handicap golfer may desire a greater weight distribution near the sole 118 of the head 102, to assist the golfer in achieving lift on a ball when struck. Additionally, a talented golfer who desires better performance for well-hit ball strikes may be better suited to a head 102 that has a higher weight distribution at the center of the face 112, and a higher handicap golfer may desire more weight distributed away from the center of the face 112 to improve performance on off-center hits. Further, a more talented golfer may desire a head 102 that has the center of gravity located more closely to the heel 120, to improve the workability of the head 102, while a higher handicap golfer may desire a head 102 that has the center of gravity located more closely to the toe 122. Still further, a particular golfer may desire a head 102 having a center of gravity located in an area according to a pattern of off-center ball strikes for that particular golfer. Various other different configurations are possible, and various other club heads 102 may be designed for various performance characteristics.

Figure 16:
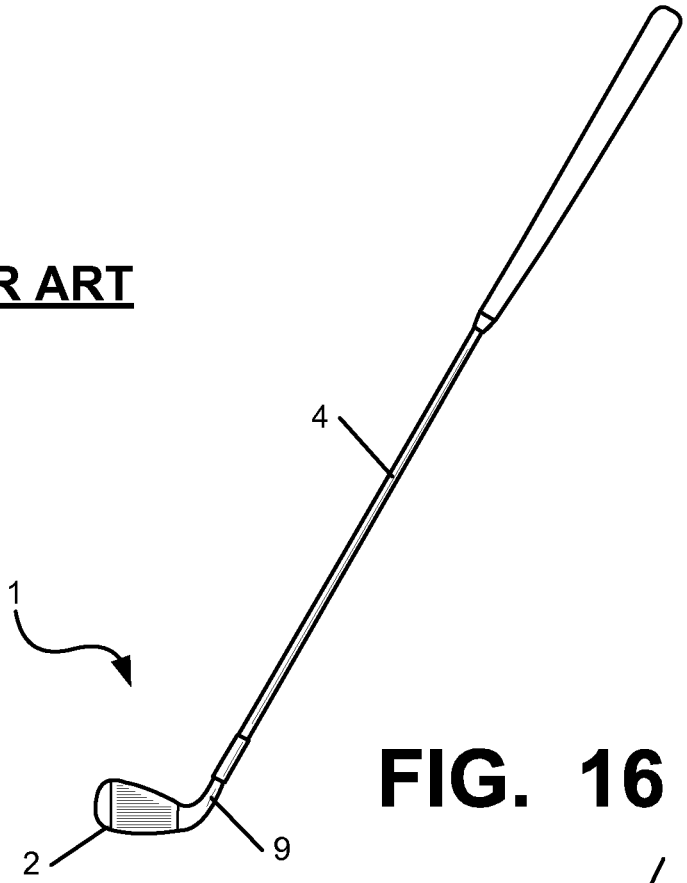
FIG. 16 is a front view of a prior art ball striking device.
Figure 17:
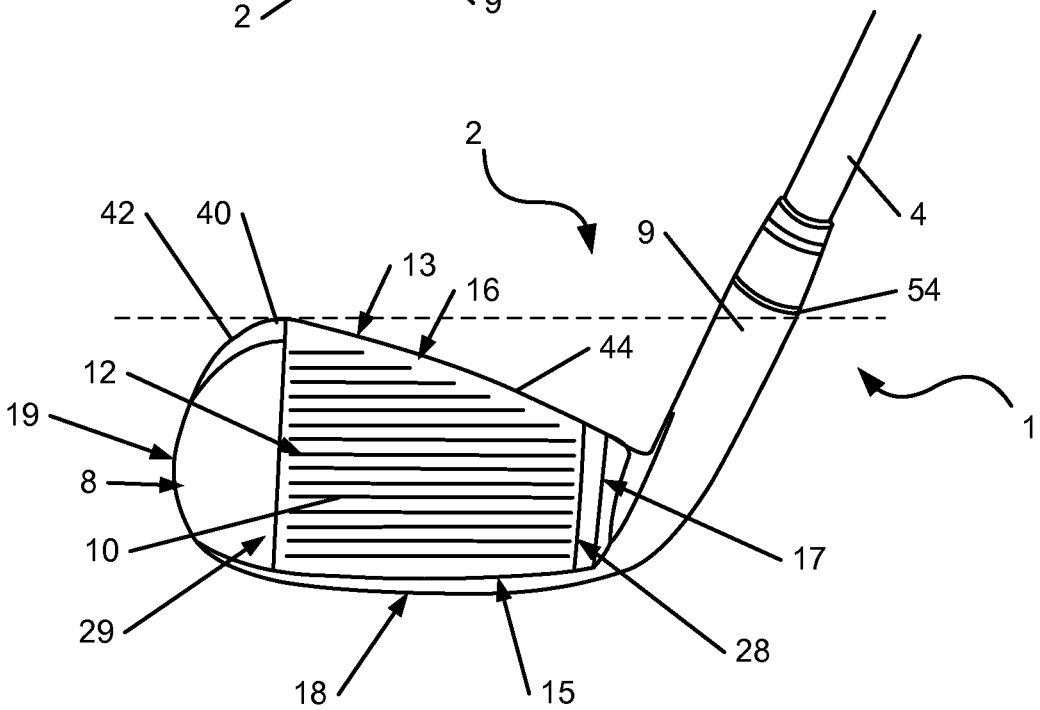
FIG. 17 is a front view of a head of the ball striking device of FIG. 16.

FIGS. 16 and 17 illustrate an example of a typical existing iron-type club 1 that includes a head 2 that includes a face 12, a body 8 connected to the face 12, and a hosel 9 connected to a shaft 4. The top edge 13 of the face 12 and the top 16 of the body 8 are curved to form a crest portion 40 that has a maximum height measured from the sole 18 to the top 16 of the head 2 and/or measured from the bottom edge 15 to the top edge 13 of the face 12. As seen in FIG. 17, the crest portion 40 is located outside the heel and toe sides 28, 29 defining the ball striking surface 10, and less than 33% of the maximum lateral width of the face 12 is located between the crest portion 40 and the toe edge 19 of the face 12. Likewise, the first sloping portion 42 extending between the toe edge 19 and the crest portion 40 is significantly smaller in length than the second sloping portion 44 extending between the crest portion 40 and the heel edge 17 and/or the hosel 9. Additionally, the hosel 9 has a much greater height, and the entirety of the second end 54 of the hosel 9 extends above the height of the crest portion 40. Further, the radius of curvature of the top edge 13 of the face 12 at the crest portion 40 is smaller than the radius of curvature of the crest portions 140, et seq. of some embodiments described herein, as described above. As such, the head 2 has a greater proportional weight distribution at the toe 22 and the hosel 9 near the top 13 of the head 2 compared to the heads 102, et seq. described above, and a smaller proportional weight distribution at the sole 18 and behind the desired impact point on the face 12. Accordingly, the head 2 has a higher center of gravity compared to the heads 102, et seq. described above.

The ball striking devices and heads therefor as described herein provide many benefits and advantages over existing products, including over a ball striking device such as the golf club 1 shown in FIGS. 16-17. For example, reducing the height of the hosel allows the amount of material in the toe area of the club head to also be reduced. This can produce the benefit of lowering the center of gravity of the head, allowing for better energy transfer for impacts near the bottom edge of the face, as well as placing greater lift on the ball when struck. This can also place a greater proportion of the weight of the club head behind the desired contact point on the face, allowing for better energy transfer for impacts in the desired contact point. Additionally, selectively eliminating weight in the toe portion and/or the hosel of the head can shift the center of gravity of the head laterally and/or vertically, providing a large number of customization options. Further, the configurations described herein may assist in moving the center of gravity further toward the rear of the head and away from the face, which can also increase control, lift, and/or energy transfer. Still further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. An iron-type golf club head comprising: an iron-type face having a ball striking surface defined thereon and a rear surface opposite the ball striking surface, the face having a bottom edge and a top edge, wherein the ball striking surface is defined by a vertical, linear heel side and a vertical, linear toe side each extending from the bottom edge to the top edge of the face, wherein the top edge of the face is arched, such that a distance from the bottom edge of the face to the top edge of the face is greater at a crest portion located between the heel side and the toe side of the ball striking surface than at the heel side or the toe side, wherein the face has a lateral width measured perpendicularly to the distance between the bottom edge of the face and the top edge of the face, and wherein at least ⅓ of the width of the face is located on both sides of the crest portion; an iron-type golf club body connected to the face, the body comprising walls extending rearward from a perimeter of the face, the walls including a sole portion defining a sole extending rearward from the bottom edge of the face, and the body further comprising a rear cavity at least partially defined by the walls and the rear surface of the face, wherein the rear cavity includes an opening to an exterior of the body; and a hosel connected to the body, wherein the hosel has a first end connected to the body and a second end extending away from the body and having a hosel opening configured for connection of a shaft, wherein the second end is located below the crest portion of the face; wherein the top edge of the face has a radius of curvature at the crest portion of from 2.5" to 3.0".

2. The iron-type golf club head of claim 1, further comprising a rear wall extending upward from the sole portion, wherein the rear wall is spaced from the rear surface of the face and the cavity is defined between the rear wall and the rear surface of the face.

3. The iron-type golf club head of claim 1, wherein the hosel is integrally formed as a single piece with the body.

4. The iron-type golf club head of claim 3, wherein the face is integrally formed as a single piece with the hosel and the body.

5. The iron-type golf club head of claim 1, wherein the top edge of the face has a rounded contour.

6. The iron-type golf club head of claim 1, wherein the crest portion is aligned approximately with a midpoint between the heel side and the toe side of the ball striking surface.

7. The iron-type golf club head of claim 1, wherein the ball striking surface has a plurality of laterally-extending linear grooves thereon.

8. The iron-type golf club head of claim 1, wherein the top edge of the face comprises a first upwardly sloping portion extending from a toe edge of the face to the crest portion, and a second upwardly sloping portion extending from the hosel to the crest portion.

9. An iron-type golf club comprising the golf club head of claim 1 and a shaft connected to the hosel.

10. An iron-type golf club head comprising:

an iron-type face having a ball striking surface defined thereon and a rear surface opposite the ball striking surface, the face having a bottom edge and a top edge, wherein the ball striking surface is defined by a vertical, linear heel side and a vertical, linear toe side each extending from the bottom edge to the top edge of the face, wherein the top edge of the face is arched, such that a distance from the bottom edge of the face to the top edge of the face is greater at a crest portion located between the heel side and the toe side of the ball striking surface than at the heel side or the toe side;

an iron-type golf club body connected to the face and extending rearward from the face, the body comprising a sole extending rearward from the bottom edge of the face, and a hosel having a first end connected to the body and a second end extending away from the body and having a hosel opening configured for connection of a shaft, wherein the second end is located below the crest portion of the face, wherein the face, the body, and the hosel combine to form a solid piece with no enclosed internal cavity, and wherein the top edge of the face has a radius of curvature at the crest portion of from about 2.5" to about 3.0".

11. The iron-type golf club head of claim 10, wherein the face, the hosel, and the body are integrally formed as a single piece.

12. The iron-type golf club head of claim 10, wherein the top edge of the face has a rounded contour.

13. The iron-type golf club head of claim 10, wherein the ball striking surface has a plurality of laterally-extending linear grooves thereon.

14. The iron-type golf club head of claim 10, wherein the crest portion is aligned approximately with a midpoint between the heel side and the toe side of the ball striking surface

15. The iron-type golf club head of claim 10, wherein the top edge of the face comprises a first upwardly sloping portion extending from a toe edge of the face to the crest portion, and a second upwardly sloping portion extending from the hosel to the crest portion.

16. An iron-type golf club comprising the golf club head of claim 10 and a shaft connected thereto.

17. An iron-type golf club head comprising: face having a ball striking surface defined thereon, the face having a bottom edge and an arched top edge; an iron-type golf club body connected to the face, the body comprising a sole extending rearward from the bottom edge of the face; and a hosel connected to the body, wherein the arched top edge of the face comprises a crest portion, a first upwardly sloping portion extending from a toe edge of the face to the crest portion, and a second upwardly sloping portion extending from the hosel to the crest portion, such that a distance from the bottom edge of the face to the top edge of the face is greatest at the crest portion, and wherein a length of the first upwardly sloping portion is approximately equal to a length of the second upwardly sloping portion, within +/−25%, wherein the hosel has a first end connected to the body and a second end extending away from the body and having a hosel opening configured for connection of a shaft, wherein the second end is located below the crest portion of the face, and wherein the face, the body, and the hosel combine to form a solid piece with no enclosed internal cavity; wherein the top edge of the face has a minimum radius of curvature of from 2.5" to 3.0".

18. The iron-type golf club head of claim 17, further comprising a rear cavity defined on a rear surface of the body located opposite the face, wherein the rear cavity includes an opening to an exterior of the body.

19. The iron-type golf club head of claim 18, further comprising a rear wall extending upward from the sole, wherein the rear wall is spaced from the rear surface of the body and the cavity is defined between the rear wall and the rear surface of the body.

20. The iron-type golf club head of claim 17, wherein the hosel is integrally formed as a single piece with the body.

21. The iron-type golf club head of claim 20, wherein the face is integrally formed as a single piece with the hosel and the body.

22. The iron-type golf club head of claim 17, wherein the top edge of the face has a rounded contour.

23. The iron-type golf club head of claim 17, wherein the ball striking surface is defined by a vertical, linear heel side and a vertical, linear toe side each extending from the bottom edge to the top edge of the face, and wherein the crest portion is located between the heel side and the toe side of the ball striking surface, such that the distance from the bottom edge of the face to the top edge of the face is greater at the crest portion than at the heel side or the toe side.

24. The iron-type golf club head of claim 23, wherein the ball striking surface has a plurality of laterally-extending linear grooves thereon.

25. The iron-type golf club head of claim 17, wherein a ratio of a length of the first upwardly sloping portion to a length of the second upwardly sloping portion is approximately 1.2:1 to 1.3:1.

26. The iron-type golf club head of claim 17, wherein the face has a lateral width measured perpendicularly to the height between the toe edge of the face and a heel edge of the face, and wherein at least ⅓ of the width of the face is located on both sides of the crest portion.

27. An iron-type golf club comprising the golf club head of claim 17 and a shaft connected to the hosel.

28. An iron-type golf club head comprising:

an iron-type face having a ball striking surface defined thereon and a rear surface opposite the ball striking surface, the face having a bottom edge and an arched top edge;

an iron-type golf club body connected to the face, the body comprising walls extending rearward from a perimeter of the face, the walls including a sole portion defining a sole extending rearward from the bottom edge of the face, and the body further comprising a rear cavity at least partially defined by the walls and the rear surface of the face, wherein the rear cavity includes an opening to an exterior of the body; and a hosel connected to the body, wherein the hosel has a first end connected to the body and a second end extending away from the body and having a hosel opening configured for connection of a shaft, wherein the arched top edge of the face comprises a crest portion, a first upwardly sloping portion extending from a toe edge of the face to the crest portion, and a second upwardly sloping portion extending from the hosel to the crest portion, such that a distance from the bottom edge of the face to the top edge of the face is greatest at the crest portion, wherein the top edge of the face has a radius of curvature at the crest portion of from about 2.5" to about 3.0", and wherein the second end is located below the crest portion of the face.

29. The iron-type golf club head of claim 28, wherein the hosel is integrally formed as a single piece with the body.

30. The iron-type golf club head of claim 29, wherein the face is integrally formed as a single piece with the hosel and the body.

31. The iron-type golf club head of claim 28, wherein the top edge of the face has a rounded contour.

32. The iron-type golf club head of claim 28, wherein the ball striking surface is defined by a vertical, linear heel side and a vertical, linear toe side each extending from the bottom edge to the top edge of the face, and wherein the crest portion is located between the heel side and the toe side of the ball striking surface, such that the distance from the bottom edge of the face to the top edge of the face is greater at the crest portion than at the heel side or the toe side.

33. The iron-type golf club head of claim 32, wherein the ball striking surface has a plurality of laterally-extending linear grooves thereon.

34. The iron-type golf club head of claim 28, wherein a length of the first upwardly sloping portion is approximately equal to a length of the second upwardly sloping portion, within +/−25%.

35. The iron-type golf club head of claim 28, wherein a ratio of a length of the first upwardly sloping portion to a length of the second upwardly sloping portion is approximately 1.2:1 to 1.3:1.

36. The iron-type golf club head of claim 28, wherein the face has a lateral width measured perpendicularly to the height between the toe edge of the face and a heel edge of the face, and wherein at least ⅓ of the width of the face is located on both sides of the crest portion.

37. An iron-type golf club comprising the golf club head of claim 28 and a shaft connected to the hosel.

38. The iron-type golf club head of claim 28, wherein the body further comprises a rear wall extending upward from the sole portion, wherein the rear wall is spaced from the rear surface of the face, the cavity is defined between the rear wall and the rear surface of the face, and the opening is defined between the rear wall and a top side of the body.

39. The iron-type golf club head of claim 10, wherein the body further comprises a rear cavity defined on a rear side of the body located opposite the face and a rear wall extending upward from the sole, wherein the rear wall is spaced from the rear surface of the face and the rear cavity is defined between the rear wall and the rear surface of the face, wherein the rear cavity includes an opening to an exterior of the body defined between the rear wall and a top side of the body.

* * * * *